United States Patent [19]

Currie et al.

[11] Patent Number: 4,578,301

[45] Date of Patent: Mar. 25, 1986

[54] FABRIC REINFORCED CEMENT STRUCTURE

[75] Inventors: Brian Currie, Dunmurry; Thomas Gardiner, Carrickfergus; Henry M. Green, Knock, all of Northern Ireland

[73] Assignees: Lambeg Industrial Research Association; Ulster Polytechnic, both of United Kingdom

[21] Appl. No.: 642,782

[22] Filed: Aug. 21, 1984

[30] Foreign Application Priority Data

Aug. 23, 1983 [GB] United Kingdom ..... 8322645

[51] Int. Cl.[4] ..... B32B 5/12

[52] U.S. Cl. ..... 428/109; 428/110; 428/111; 428/234; 428/247; 428/252; 428/284; 428/300; 428/703

[58] Field of Search ..... 428/703, 105, 109, 110, 428/111, 234, 247, 252, 284, 300

[56] References Cited

U.S. PATENT DOCUMENTS 4,203,788 5/1980 Clear ..... 428/703

*Primary Examiner*—James J. Bell

*Attorney, Agent, or Firm*—Harry M. Weiss & Associates

[57] ABSTRACT

A composite material is composed of a matrix of water hardenable material such as a portland-cement-based mixture, and reinforcement consisting of a plurality of layers of open-mesh textile fabric, each layer including two sets of straight lying parallel textile elements united to form the fabric. The width of the elements in each set is preferably chosen so that there is formed within the reinforcement a plurality of irregular cavities extending throughout the thickness of the reinforcement and filled with material of the matrix to form irregular plugs of the matrix material tending to unite the layers of fabric and distribute stresses between them. The individual textile elements may be monofilaments of various cross-sectional form, spun yarns, bundles, rovings, or composite filaments. The elements of the two sets can be united by wearing, weaving, additional yarns or adhesive.

13 Claims, 9 Drawing Figures

FABRIC REINFORCED CEMENT STRUCTURE

This invention relates to the reinforcement of cement structures with textile materials.

The idea of incorporating fibres as reinforcement in a building product is not new and there are several known methods of achieving this aim.

A first known method makes use of short staple fibres, often used in a spray-on technique, which produces a random distribution of fibres in a thin layer (two-dimensional) or a thick layer or mass (three dimensional). Fibres used in this way include asbestos, glass, steel and polypropylene. Such a random array of fibres in one plane means that the load carried is about one-third of that which could be carried if the fibres had been aligned in the direction of the stress. Where the reinforcement is thicker and effectively in three dimensions, the load carried is reduced to approximately one-sixth of that which could be carried by aligned fibres.

A second method as described in U.K. Pat. No. 1582945 tries to align the fibres, but not necessarily in the direction of stress, since the fibres are linked, not in parallel fashion, but as a series of diamond shapes. This pattern is achieved by opening out a fibrillated film into a very fine network. The reinforcement is achieved by incorporating the textile web, layer upon layer, in a cement matrix. The spacing of the cement stress cracks formed, under load, in the tension face is related to the fineness of the fibre which gives a theoretical base for this technique. However, the practical difficulties of handling large numbers of textile layers of spiders-web-like proportions in the robust world of the cement industry are considerable. Fibrillated film or tape also has the disadvantage that during the fibrillation process the physical action of pinning through the film or tapes reduces the inherent strength of the reinforcement textile by some 20 to 50 per cent, or more, depending on the degree of fibrillation and the draw ratio employed during the extrusion process.

U.K. Pat. Application No. 2111093 describes a composite structure wherein a cement matrix is reinforced by an array of fibres laid in a semi-random web. However, the fibres of this patent are generally curved by or sinusoidally laid and thus not capable of comprising maximum strength to the composite. An object of the present invention is to produce an improved reinforced cement structure.

The invention provides a composite structure comprising a water-hardenable matrix and reinforcement in the form of a plurality of layers of open mesh textile fabric, each layer of textile fabric being composed of a plurality of united sets of textile elements, the elements of each set lying straight and parallel to each other.

The reinforcing fabric can consist of continuous textile elements in the form of tapes, rovings or filament yarns placed with control and precision within the fabric construction. These textile elements can be aligned in the direction of stress and are normally in two directions placed at right angles to one another as in normal warp and weft woven structures. However such construction may also include other directional elements as for example in triaxial woven fabrics. These fabrics are of robust construction, give uniform and consistent properties throughout their length and width so uniformity of the finished reinforced cement product is practically guaranteed. The mesh grid opening at the cross-over points of these elements can be chosen to allow easy entry of the cement slurry during loading or filling using say, a vibration technique. Further these grid openings are essentially regular and repeated across the fabric face.

The invention will be described further, by way of example, with reference to the accompanying drawings, wherein.

Figure 2:
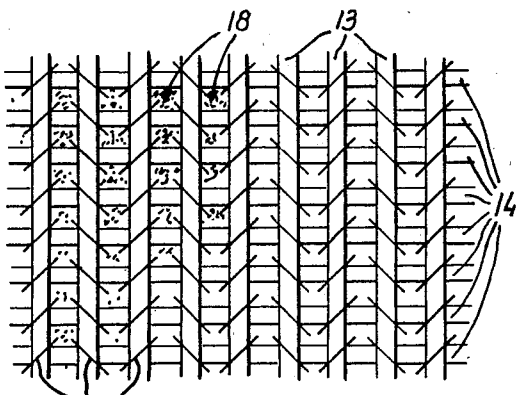
FIG. 2 is a similar view showing use of a cross-lay fabric.
Figure 4:
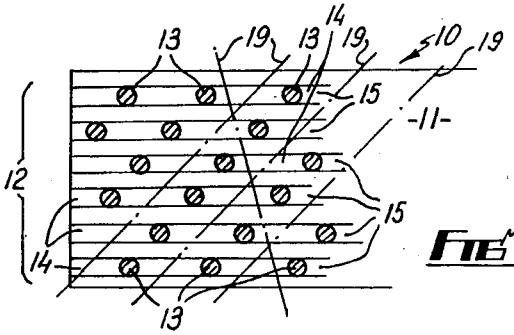
FIG. 4 is a cross-sectional view through a composite material of the invention, the material and reinforcement being shown schematically.
Figure 1:
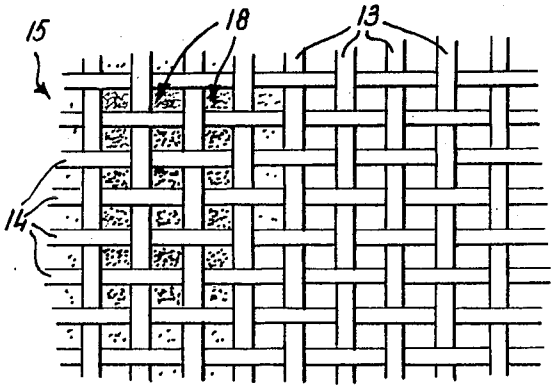
FIG. 1 is a schematic plan view showing a cement structure having a woven reinforcement fabric within a cement matrix.
Figure 3:
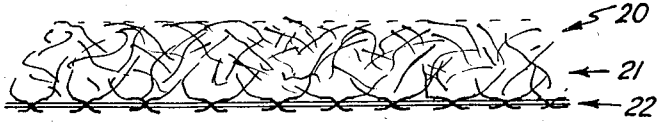
FIG. 3 is a side view of a composite textile material which can be used as additional reinforcement.

Preferred composite materials of the invention are illustrated schematically and generally in FIGS. 1, 2 and 4 of the accompanying drawings. The materials all comprise a matrix formed from a water-hardenable substance such as portland cement. Other cements such as pozzolanas and special cements can be used. The mixtures used, ie ratios of sand/cement/water can be varied widely within the usual limits used for cement structures. Typically a ratio of 1:1 by weight of cement to fine sand is used and the amount of water is kept as low as possible commensurate with workability of the mix and adequate filling of the interstices of the reinforcement.

The sizes of structures manufactured in accordance with the invention can vary widely in dependence upon their eventual field of use, and the type and amount of reinforcement will vary accordingly. However, the textile material constituting reinforcement of the matrix must consist of a number of layers of textile fabric, each fabric consisting of a plurality of united sets of regularly disposed straight parallel textile elements. The sets can be united by weaving, by a cross-lying array of secondary securing filaments, by adhesive or by welding. The sets can conventiently be two sets lying at right angles to each other, as weft and warp in a woven fabric or any other convenient number of sets of threads. For example three sets of threads arranged in a triaxial fabric. The individual textile elements can be individual monofilaments or tapes, spun filaments, bundles or rovings or composite filaments. A preferred material for the elements is polypropylene, but any convenient polymer or blend of polymers can be used. Because of the intrinsically smooth nature of most polymers, it can be advantageous to treat the elements to impart surface roughness or texture thereto to encourage bonding between the textile elements and the matrix material.

When a plurality of layers of a mesh-like textile fabric are disposed closely together as reinforcement, it will be appreciated that there will be formed a plurality of small cavities extending transversely of the major planes of the layers and generally transversely of the major plane of a sheet of composite material, such cavities being filled with material of the matrix. If the textile layers were all identical and laid in exact register, such cavities would be exactly at right angles to the major plane and of constant width and length throughout the body of reinforcement. When the fabric layers are laid in practice, absolute alignment is not achievable without considerable expenditure and care, which is incompatible with ease and speed of manufacture. Accordingly, the cavities generated will lie at various angles depending on the relevant relationships between the textile elements. This feature is illustrated generally in FIG. 4.

The "plugs" of matrix formed by the solidification of matrix material in such cavities are short and stubby in form, a typical "ideal" plug in a 10 mm thick sheet of composite material being 10 mm long and 4 to 6 mm square. Actual plugs are in fact arranged at various angles and may be from 10 to 15 mm long and 3 to 6 mm on each side. In any event, they are quite strong and resistant to bending and shear stresses.

However, it will be appreciated, that to ensure that such plugs are always formed and are always of appreciable size, the separation between adjacent ones of the textile elements making up each set of such elements must be greater than the width of each such element. Preferably the separation between an adjacent pair of elements should be greater than 1.5 times the width of the individual elements and preferably from 2 to 10 times such width. The upper limit to such range is set not by the described plugging function but by the reduced reinforcement function achieved at greater spacings. This factor, together with the consideration that wider mesh fabrics have a tendency to pack together more than closer mesh fabrics, thus reducing the size of such cavities, makes a range of from 3 to 6 most relevant, combining adequate reinforcement with adequate "plugging" strength.

The large number of such plugs in the matrix extending generally transversely of the major plane of a board or sheet has a major effect in preventing deformation of the sheet. As a sheet is bent as a beam, the fabric layers, or some of them, are loaded in tension and thus resist bending. Any tendency of an outermost fabric layer, most highly stressed, to separate or de-laminate, is reduced by the plugs which tend to unite the various layers of fabric and compel them to move together, increasing the sheet strength and raising the load level at which de-lamination or sheet failure occurs.

As specifically illustrated in FIGS. 1, 2 and 4, a typical panel 10 of composite material of the invention comprises a matrix 11 of cement based settable material reinforced with a textile structure 12 consisting of a plurality of layers of a textile fabric 15. Each layer of fabric 15 consists of two sets 13, 14 of textile elements in the form of polypropylene monofilaments. The elements are disposed parallel to each other and lie substantially in straight lines giving optinum reinforcement. The fabric 15 of FIG. 1 is a woven fabric, the sets 13, 14 consisting of warp and weft. FIG. 2 shows a cross-lay fabric, wherein the sets 13, 14 are laid one on top of the other and are secured by additional yarns or threads 17. These additional yarns 17 do not add significantly to the reinforcement function, they serve only to unite the elements 13, 14. FIG. 4 is a schematic cross-sectional view, showing a plurality of layers of fabric 15 within a matrix 11. The section shows the relationship between the various sets 13, 14 of textile elements in defining cavities 18 within the reinforcement which are filled with matrix material to form plugs whose general axes are indicated by lines 19. It will be seen that the disposition of the elements of sets 13 cannot be such as to bridge such cavities, ensuring that they are always present. The same feature exists in a plane at right angles to the plane of the drawing and is not illustrated further. For the sake of clarity on this point the overlap of layers 13 and 14 has not been shown in FIG. 4. The inevitability of such plugs is achieved by the choice of the size of elements 13 and their spacing as described previously.

Fabric 15 has circular elements 13, 14 each some 1.5 mm in diameter, the separation between adjacent elements being 5 mm.

It has been shown experimentally that the pegging, or plugging, of the cement matrix in and through layers of these fabrics result in the transfer of shear forces within the composite when tested in flexure. The number of layers used within the composite and their placement relative to the axis of bending may be calculated. It has been shown that the pitch of the controlled cracking on the tension face under flexure is related to the mesh grid spacing. Secondary bonding may occur, particularly when filament yarns or rovings are used, at the interface between the textile element and the cement matrix.

The mesh grid structure of the textile elements used as described may be fixed or stabilised by known means of bonding by thermal, chemical, mechanical or other such methods. Such stabilised fabrics allow robust handling during the laying process in production without disruption of the regular grid pattern of the textile. The number of these textile layers used in such composites may be reduced by a factor of six when compared to fibrillated network forms.

The preferred tape used in a woven construction may be produced by a process in which grooves are roller embossed under pressure into the extruded film from which the tapes are made. The tape surface is thus profiled in section having embossed grooves in controlled number and depth running along the tape length. Such a process produces tape with enhanced physical properties e.g. strength may be increased from up to 15 to 20 percent and extension reduced from 25 to 18 percent. The tape surface profile may aid secondary bonding. However other means of tape surface modification may be employed such as a known delustering process. Alternatively additives may be used, such as calcium carbonate, in the polymer mix at levels to effect tape surface characteristics and also to cause reduction in creep property. By the above means bond strength between the textile elements and the matrix may be improved, and the load/extension performance of the elements themselves improved, to produce higher modulus values and therefore improved reinforcement performance. Alternatively cross-lay fabrics may be used in which the textile elements lay flat across the fabric face which can reduce or eliminate fabric crimp evident in some woven fabrics. A knitted roving construction may be used in which monofilament yarns in predetermined grid mesh pattern are fixed by means of cross-stitching using a third textile element. Other forms of fixed grid structure may be employed as reinforcement and these may be formed at the die-head during extrusion.

In some structures a non woven textile of suitable fibre density may be added to the reinforcement mesh by means of needling or other forms of bonding. Sandwich layers of woven and non-woven textiles may also be employed according to the complexity of the reinforcement required. Certain non-critical bulk reinforcement may be achieved by use of a non-woven textile only, made to the thickness of the finished product, and be of such fabric density as to allow a cement matrix fill in one operation. Certain three dimensional type woven fabrics, usually made from monofilament, may also be employed as reinforcement layers singly or within an assembly of layers.

In summary, it will be seen that regular fixed grid reinforcement textiles may be produced singly or in composite form in a number of ways. The textile elements themselves, in the form of tapes or yarns, may be produced to give optimum performance for particular applications. Thus textile reinforced structures may now be 'engineered' to a particular specification within close limits and their inclusion in a cement matrix effected by relatively simple means in a production process.

The matrix i.e. that part of the composite which is not fabric, composes a water hardenable mass such as cement and sand.

It may be of any material which hardens by a chemical reaction upon the addition of water e.g. Portland cement, special cements, gypsum, pozzolanas etc. It is also possible to use a resin based material as the binding agent of the matrix.

The sand may be normal fine sand of silica sand.

To give a range of properties additives and/or admixtures may be incorporated. These may be accelerators, retardents, water reducing agents, polymer latex admixtures, plasticisers, air extraining agents, bonding agents, frost inhibitors, expanding agents, pigments, water proofing agents etc.

The water will normally be drinkable although many of the above additives may be incorporated in the water before mixing with the sand and/or cementatious material.

The compaction may be achieved by hand rolling, vibration—either by hand or mechanically by poker vibrators or vibrating table, pressure applied via plates, rollers, presses etc.

To achieve optimum results the composite should be cured. Curing is a process which, among other advantages, permits water to be available for the continuous hydration of the cementitious matrix. This may be achieved by various methods e.g. covering the product with damp hessian cloth, polythene sheeting, wet sand, saw dust, earth etc. Other means are to spray with a curing compound, steam curing, autoclaving, steam and water curing, electrical curing, ponding, submerging or other such methods.

Figure 5:
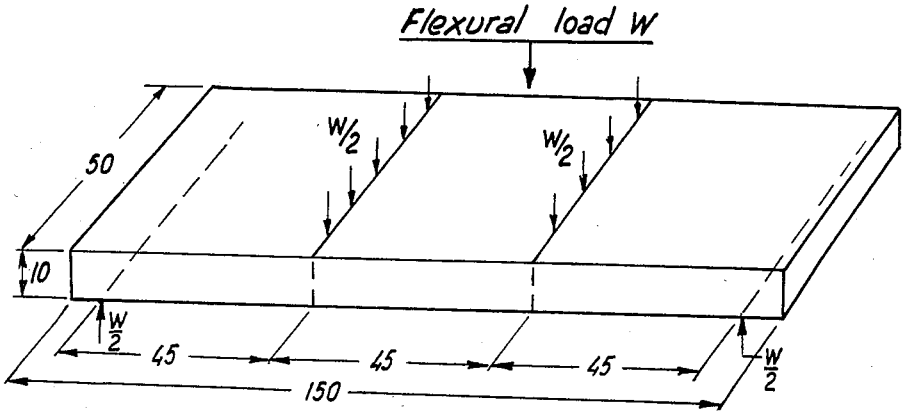
FIG. 5 illustrates how a test sample has been loaded.
Figure 6:
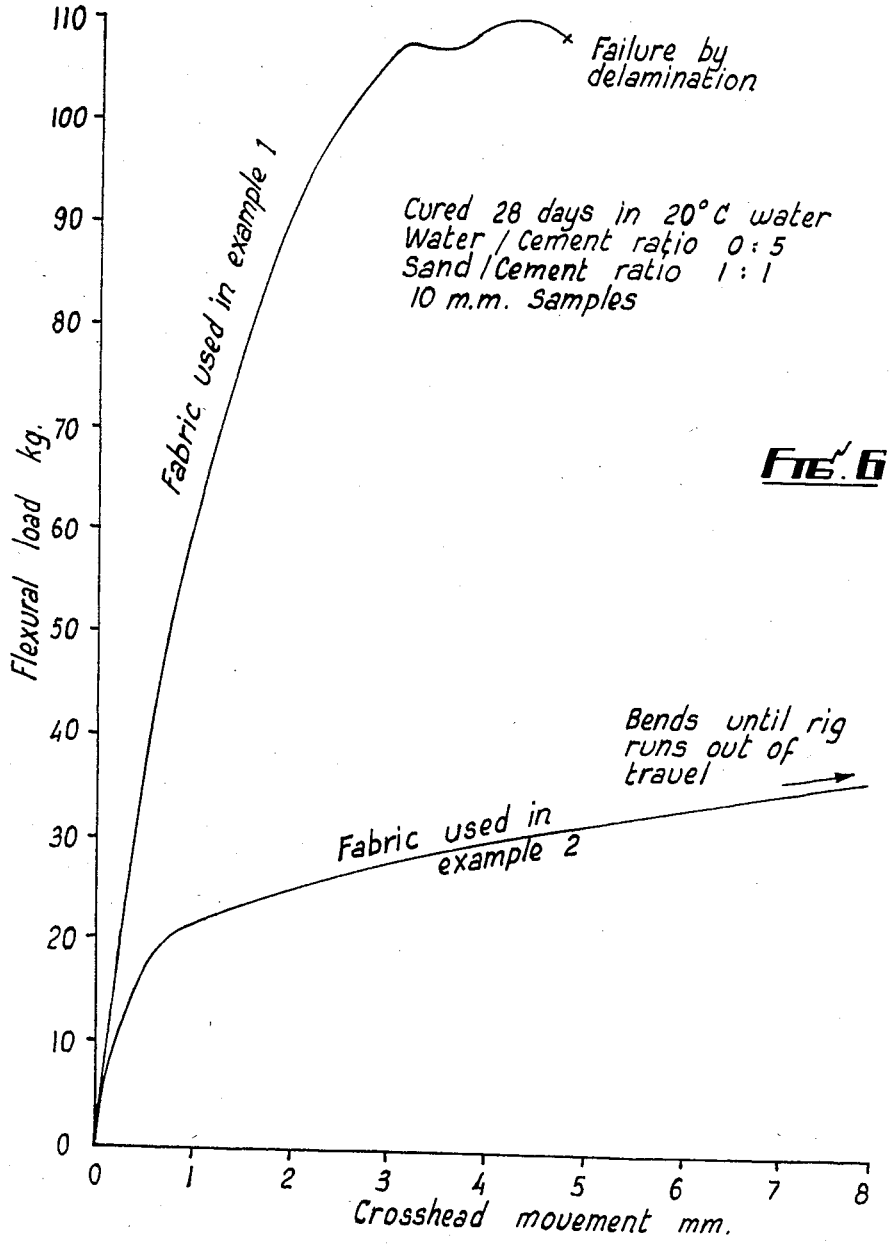
FIG. 6 is a graph of stress against strain for two composite materials tested.

EXAMPLES (1) A test specimen was manufactured measuring 150 mm×50 mm×10 mm thick. It was supported and loaded as shown in FIG. 5. The reinforcing element consisted of 10 layers of a polypropylene mesh fabric 15. The resultant load and crosshead movement is shown in FIG. 6, the sample being tested in an Instron Machine.

(2) A test specimen was manufactured measuring 150 mm ×50 mm×10 mm thick. It was supported and loaded as shown in FIG. 1. The reinforcing element consisted of 10 layers of a polypropylene mesh fabric but different in construction to that of Example 1. The resultant load and crosshead movement is shown in FIG. 6, the sample being tested in a Instron Machine.

A comparison of the results obtained in Examples 1 and 2 indicates how a composite can be designed to meet various strength and flexibility requirements.

(3) Test specimens were manufactured measuring 150 mm×50 mm×6 mm thick. They were supported and loaded as shown in FIG. 5. The reinforcing element consisted of 6 layers of a polypropylene mesh fabric. One of the samples was stored under water at 20° C. and the other in the outside atmosphere.

Figure 7:
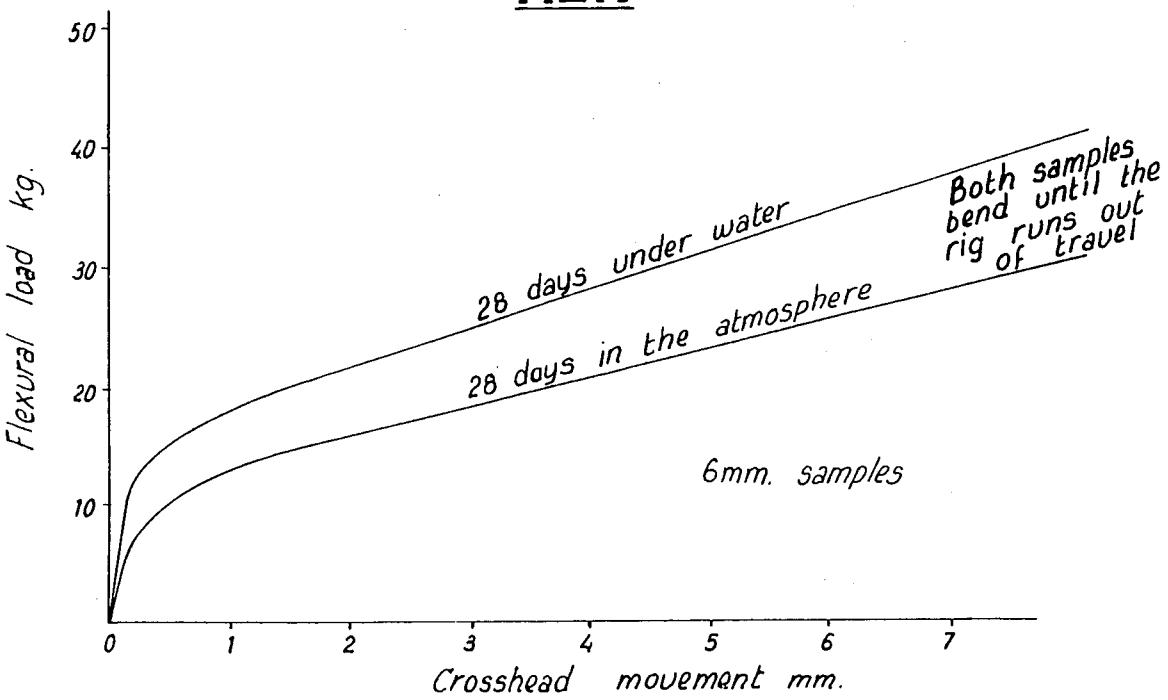
FIG. 7 is a similar graph showing the effect of curing.

The resultant load and crosshead movement is shown in FIG. 7, the samples being tested in an Instron Machine.

The results show the importance of a proper curing of the composite.

Figure 8:
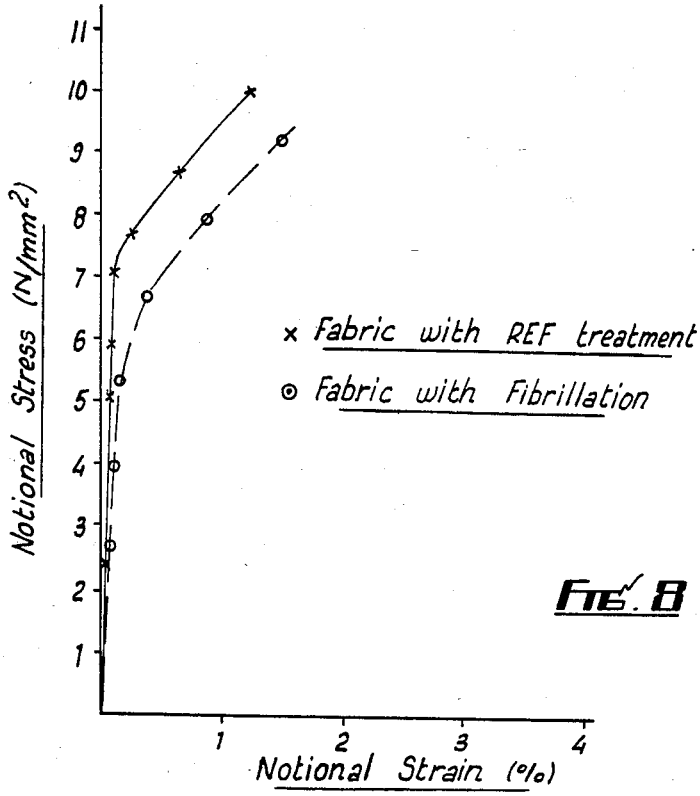
FIG. 8 is a similar graph showing the effect of surface treatment of the elements of the reinforcement fabric.

(4) Test specimens were manufactured measuring 150 mm×50 mm×6 mm thick. They were supported and loaded as shown in FIG. 5. The reinforcing element consisted of 6 layers of a polypropylene mesh fabric, except that in one sample the weft tapes were fibrillated and in the other the weft tapes were embossed. The resultant notional stress and notional strain curves are shown in FIG. 8.

This shows that different responses can be obtained by different tape treatment. It is not intended that embossing and fibrillation are the only treatments available.

Figure 9:
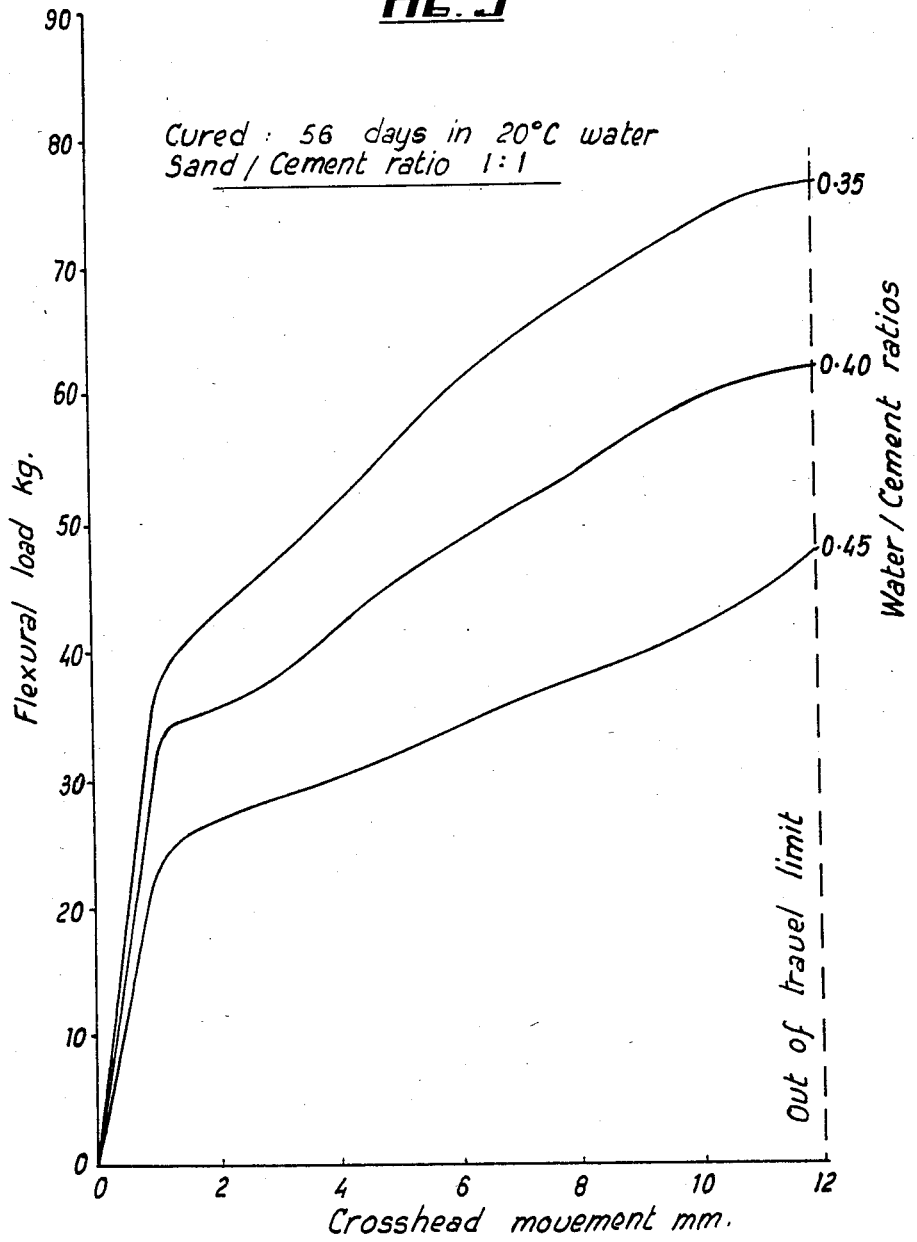
FIG. 9 is a similar graph showing the effect of varying water/cement ratios in the matrix of composite materials of the invention.

(5) The effect of changing the matrix, as opposed to the reinforcing element, is indicated in FIG. 9. The change here shown involves the water/cement ratio, but many other variations can be made as outlined in the patent.

(6) To illustrate the use of the composite as a reinforcing element within a larger unit a paving slab was manufactured. This had dimensions of 610 mm×610 mm×20 mm thick. The tension face was reinforced using 10 layers of fabric 15 embedded in the matrix and the compression face composed of unreinforced concrete acting as a wearing surface. This unit was bedded in sand and loaded using a hydraulic jack and lorry wheel to 30 kN. The test was stopped at this load because of severe deformation of the tire. When examined, after unloading, the slab showed no visible sign of damage. This design showed that standard paving slabs could be reduced in thickness and weight by a factor of at least two with subsequent reduction in handling and transport costs.

(7) To illustrate the versatility of the composite the following prototypes have been made.

(i) a small scale prefabricated house.
(ii) angle, channel and box sections.
(iii) sandwich panels.
(iv) flagstones
(v) pipes and pipe couplings.
(vi) sewer linings
(vii) roof tiles and slates.
(viii) corrugated sheet.
(ix) profiled sheet
(x) permanent formwork
(xi) a coal bunker
(xii) garden furniture
(xiii) a canoe
(xiv) coping stones
(xv) ridge tiles.

A wide range of surface finishes for panels and other components is possible, ranging from very smooth to very rough. The surface finish can be such as to give and/or receive a cosmetic or architectural requirement or structural to assist bonding to other materials such as stone, slate, polystyrene, and/or other components.

The edge(s) of panels or the like can similarly be treated enabling connections to adjoining units to be made. This can be done mechanically, for example by bolting or by profiling the edge, or by lapping protruding fabric at the joint and making monolithic with a rendering appropriate matrix, e.g. cement.

While the invention has been particulary shown and described in reference to preferred embodiments thereof, it will be understood by those skilled in the art that changes in the form and details may be made therein without departing from the spirit and scope of the invention.

We claim:

1. A composite structure comprising a water-hardened matrix and reinforcement comprising a plurality of layers of open mesh textile fabric, each layer of said textile fabric being composed of a plurality of united sets of textile elements, said elements of each said set lying straight and parallel to each other, the spacing between adjacent elements is greater than the widths of each of said elements, and a plurality of irregular cavities extending transversely of and within said reinforcement and containing plugs of said matrix material.

2. A structure as set forth in claim 1, wherein said textile elements are selected from the group consisting of monofilaments, spun yarns, tapes, bundles, rovings, and composite filaments.

3. A structure as set forth in claim 1, wherein said spacing is at least 1.5 times the width of said individual elements.

4. A structure as set forth in claim 3, wherein said spacing is from 2 to 10 times the width of said individual elements.

5. A structure as set forth in claim 4, wherein said spacing is from 5 to 6 times the width of said individual elements.

6. A structure as set forth in claim 1, wherein there are two sets of said elements woven together.

7. A structure as set forth in claim 1, wherein there are two sets of said elements laid one on the other and united by additional means.

8. A structure as set forth in claim 7, wherein said additional means is selected from the group consisting of additional threads; adhesive; and welding.

9. A structure as set forth in claim 1, wherein said textile elements are treated to have a surface capable of bonding with said matrix material.

10. A structure as set forth in claim 1, wherein said textile elements are of polypropylene.

11. A structure as set forth in claim 1, wherein said matrix material is selected from the group consisting of Portland cement, gypsum based cement, pozzolanas, and special cements.

12. A composite material as set forth in claim 1, wherein there is added to said textile reinforcement an additional layer of material comprising a base fabric and a layer of non-woven fibres.

13. A method for forming a composite structure comprising forming a water-hardenable matrix and reinforcement in the form of a plurality of layers of open mesh textile fabric, each layer of said textile fabric being composed of a plurality of united sets of textile elements, said elements of each said set lying straight and parallel to each other.

* * * * *